US006398341B2

(12) United States Patent
Niikura

(10) Patent No.: US 6,398,341 B2
(45) Date of Patent: Jun. 4, 2002

(54) PRINTING APPARATUS AND PRINTING CONTROL METHOD

(75) Inventor: Takeji Niikura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/727,538

(22) Filed: Dec. 4, 2000

(30) Foreign Application Priority Data

Dec. 15, 1999 (JP) ..... 11-356021

(51) Int. Cl.[7] ..... B41J 19/18
(52) U.S. Cl. ..... 347/37
(58) Field of Search ..... 347/5, 7, 19, 37, 347/56

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,608,577 | A | 8/1986 | Hori | 347/66 |
| 4,723,129 | A | 2/1988 | Endo et al. | 347/56 |
| 4,740,796 | A | 4/1988 | Endo et al. | 347/56 |
| 6,260,945 | B1 * | 7/2001 | Niikura | 347/37 |

FOREIGN PATENT DOCUMENTS

| | | |
|---|---|---|
| EP | 0 754 559 | 1/1997 |
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Anh T. N. Vo
(74) *Attorney, Agent, or Firm*—Fitzpatrick, Cella, Harper & Scinto

(57) ABSTRACT

A recording apparatus includes a first determination unit for determining a position to start scanning of a recording head relative to a recording medium for each scanning operation during recording, based on recording data input by an input unit, a setting unit for setting a permissible region to start scanning in a next scanning operation, based on a position to start scanning in a preceding scanning operation, and a second determination unit for determining a position within the permissible region as a position to start scanning of the recording head by a scanning unit, when it has been determined that the position to start scanning for the next scanning operation is outside of the permissible region, based on a result of discrimination by the discrimination unit.

32 Claims, 14 Drawing Sheets

FIG.12

| HEAD TYPE / MODE | MONOCHROME | COLOR | PHOTOGRAPH |
|---|---|---|---|
| HQ, Fine | MEDIUM SPEED | MEDIUM SPEED | - |
| HS | HIGH SPEED | HIGH SPEED | - |
| SMOOTHING | LOW SPEED | - | - |
| PHOTOGRAPH | - | - | LOW SPEED |

PRINTING APPARATUS AND PRINTING CONTROL METHOD

BACKGROUND OF THE INVENTION

1. Field of the Invention

The present invention relates to a printing apparatus and a printing control method, and more particularly, to a printing apparatus and a printing control method for forming an image by scanning a recording head.

2. Description of the Related Art

A recording apparatus having the function of a printer, a copier, a facsimile apparatus or the like, or a recording apparatus used as an output apparatus for a composite electronic apparatus including a computer, a word processor and the like, or a work station is configured so as to record an image on a recording medium, such as paper, a plastic thin film or the like, based on image information. Such recording apparatuses can be classified into an ink-jet type, a wire-dot type, a thermal-recording type, a laser-beam type and the like, based on how the image is recorded.

In serial-type recording apparatuses that adopt serial scanning in which main scanning is performed in a direction crossing the conveying direction of a recording medium (a sub-scanning direction), recording on the entire recording medium is performed by recording an image using recording means mounted on a carriage which moves along the recording medium, by repeating the operation of performing sheet feeding by a predetermined amount (pitch conveyance) after completing recording for one line on the recording medium and then performing recording for the next line on the recording medium which has stopped after the pitch conveyance.

FIG. 13 is a diagram illustrating an example of accuracy in recorded positions when a recording head has performed recording on one line (measurement of deviations in the positions of dots recorded with an interval of 1/90 inch).

In FIG. 13, the positions of recorded dots with reference to the position to start recording are shown, and the ordinate indicates the accumulated amount of deviation from the position where the dot is intended to be recorded. The positive side of the ordinate represents a deviation in a direction away from the home position of the recording head making the position to be recorded 0, and the negative side represents a deviation in a direction toward the home position.

Usually, recording is performed after the carriage motor has reached a constant speed. Hence, the carriage is moved by beginning driving the carriage motor from a position slightly before the position to start recording. As a result, as can be understood from FIG. 13, accuracy in recording is somewhat inferior immediately after starting the carriage motor for driving the carriage (i.e., near the position to start recording), such that the amounts of deviation in recorded positions are ±40 $\mu$m–50 $\mu$m. Thereafter, recorded positions are stabilized, such that the amounts of deviation are ±10 $\mu$m–20 $\mu$m.

Accordingly, for example, when recording stepwise ruled lines as shown in FIG. 14 on a recording medium P, the position to start recording differs in each scanning operation by the recording head, and the position to begin driving the carriage motor gradually changes at each step of the ruled lines. As a result, the position to start the movement of the carriage shifts from the starting position of the preceding scanning line.

This problem will be described with reference to FIG. 13.

In FIG. 13, a curve formed by black dots indicates changes in the amounts of deviation of recorded positions generated on a certain line when recording stepwise ruled lines, and a curve formed by broken lines indicates changes in the amounts of deviation of recorded positions generated on the next line. The curve formed by broken lines starts from a position different from the position of the curve formed by solid lines, because the next stepwise ruled line shifts to the right by the amount of a step portion.

When such stepwise ruled lines are recorded, then, as shown in FIG. 13, a deviation as much as about 70 $\mu$m sometimes occurs between adjacent recorded lines.

Particularly, such deviations are pronounced at border portions of the ruled lines, such as positions a, b and c shown in FIG. 14, thereby causing degradation in the quality of the recorded image.

In recording apparatuses for forming black by superposing printing materials of a plurality of colors, i.e., Y (yellow), M (magenta) and C (cyan), such deviations will cause a color deviation, thereby greatly degrading the quality of the recorded image.

In order to solve such problems, for example, EP Patent Publication No. 0754559A has proposed a configuration in which, in order to remove deviations in recorded positions when starting recording, the position to start each scanning operation of the carriage is adjusted to an integer multiple of the distance of movement of the carriage according to the revolution of a stepping motor corresponding to one period of the exciting phase of the motor.

Since the vibration of the mechanical portion is dominant as the cause of the amount of deviation with respect to an absolute position from the position to start recording shown in FIG. 13, except for a case in which nonuniformity due to cogging, serving as nonuniformity in the revolution of the carriage motor itself, is pronounced, it is necessary to provide countermeasures for this vibration. This vibration has a unique period.

Accordingly, the following countermeasures have been provided.

(1) By mounting an encoder in the recording apparatus and detecting the absolute position of the carriage, accuracy in the position to form each dot for an accurate image is assured.

(2) Since a stepping motor is most commonly used for driving the carriage, the motor is started with a low number of revolutions, and recording is performed after the number of revolution of the motor reaches a predetermined value. When intending to stop the carriage, the revolution of the motor is decelerated from the used number of revolutions, and the motor is stopped after reducing the number of revolutions to a low value. By increasing the distance during the start of the motor, variations in the speed of the carriage at the number of revolutions used during recording are minimized, so that accuracy in the position to form each dot for an accurate image is secured.

However, in the above-described conventional approach, since additional components such as an encoder and the like are required, the cost of the apparatus increases. An increase in the conveying distance during the start of the motor results in a reduction of the effective recording length, or in an increase in the size of the apparatus in order to assure a sufficient effective recording length.

SUMMARY OF THE INVENTION

It is an object of the present invention to provide a recording apparatus and a recording control method which can perform accurate recording without increasing the production cost and the size of the apparatus.

According to one aspect, the present invention which achieves the above-described object relates to a recording apparatus including scanning means for mounting a recording head for forming an image on a recording medium and for performing reciprocating scanning in a first direction, conveyance means for conveying the recording medium in a second direction transverse to the first direction, input means for inputting recording data, first determination means for determining a position to start scanning of the recording head relative to the recording medium for each scanning operation during recording, based on the recording data input by the input means, setting means for setting a permitted or permissible region to start scanning in a next scanning operation, based on a position to start scanning in a preceding scanning operation, discrimination means for discriminating whether or not a position to start scanning for the next scanning operation is within the permitted region, second determination means for determining a position within the permitted region as a position to start scanning of the recording head by the scanning means, when it has been determined that the position to start scanning for the next scanning operation is outside of the permitted region to start scanning based on a result of discrimination by the discrimination means, and movement means for moving the recording head to the position determined by the second determination means.

According to another aspect, the present invention which achieves the above-described object relates to a recording apparatus including scanning means for mounting a recording head for forming an image on a recording medium and for performing reciprocating scanning in a first direction, conveyance means for conveying the recording medium in a second direction transverse to the first direction, input means for inputting recording data, first determination means for determining a position to start recording of the recording head on the recording medium for each scanning operation during recording, based on the recording data input by the input means, and setting means for dividing a recordable area of the recording medium into regions along the first direction, with each region having a predetermined width in the first direction and for setting a position to start scanning for each of the regions. The predetermined width equals a pitch of vibration of the scanning means. The apparatus also includes second determination means for determining a position to start scanning for each scanning operation, depending on which region the position to start recording is located, and movement means for moving the recording head to the position to start scanning determined by the second determination means for each scanning operation.

According to still another aspect, the present invention which achieves the above-described object relates to a recording control method applied to a recording apparatus mounting a recording head for forming an image on a recording medium and having a carriage for performing reciprocating scanning in a predetermined direction. The method includes an input step of inputting recording data, a first determination step of determining a position to start scanning of the recording head relative to the recording medium for each scanning operation during recording, based on the recording data input in the input step, a setting step of setting a permitted or permissible region to start scanning in a next scanning operation, based on a position to start scanning in a preceding scanning operation, a discrimination step of discriminating whether or not a position to start the next scanning operation is within the permitted region, and a second determination step of determining a position within the permitted region as a position to start scanning of the recording head, when it has been determined that the position to start scanning of the next scanning operation is outside of the permitted region, based on a result of discrimination in the discrimination step, and a movement step of moving the recording head to the position determined in the second determination step, before recording in the next scanning operation.

According to yet another aspect, the present invention which achieves the above-described object relates to a recording control method applied to a recording apparatus mounting a recording head for forming an image on a recording medium and having a carriage for performing reciprocating scanning in a predetermined direction. The method includes an input step of inputting recording data, a first determination step of determining a position to start recording of the recording head on the recording medium, based on the recording data input in the input step, and a setting step of dividing a recordable area of the recording medium into regions along the predetermined direction, with each region having a predetermined width in the predetermined direction and for setting a position to start scanning for each of the regions. The predetermined width equals a pitch of vibration of the carriage. The method also includes a second determination step of determining a position to start scanning for each scanning operation, depending on which region the position to start recording is located, and a movement step of moving the recording head to the position to start scanning determined in the second determination step for each scanning operation.

According to yet another aspect of the present invention, a recording apparatus includes a scanning unit, a conveyance unit, an input unit and a processor. The scanning unit includes a carriage for mounting a recording head for forming an image on a recording medium and a carriage motor for reciprocatingly scanning the carriage in a first direction. The conveyance unit conveys the recording medium in a second direction transverse to the first direction. The input unit inputs recording data. The processor determines a position to start scanning of the recording head relative to the recording medium for each scanning operation during recording, based on the recording data input by the input unit, and sets a permissible region to start scanning in a next scanning operation, based on a position to start scanning in a preceding scanning operation. The processor further discriminates whether or not a position to start scanning for the next scanning operation is within the permissible region, determines a position within the permissible region as a position to start scanning of the recording head by the scanning unit, when discriminated that the position to start scanning for the next scanning operation is outside of the permissible region to start scanning, and controls the scanning unit to move the recording head to the predetermined position.

According to still another aspect, a recording apparatus includes a scanning unit, a conveyance unit, an input unit and a processor. The scanning unit includes a carriage for mounting a recording head for forming an image on a recording medium and a carriage motor for reciprocatingly scanning the carriage in a first direction. The conveyance unit conveys the recording medium in a second direction transverse to the first direction. The input unit inputs recording data. The processor determines a position to start recording of the recording head on the recording medium for each scanning operation during recording, based on the recording data input by the input unit, divides a recordable area of the recording medium into regions along the first direction, with each region having a predetermined width in the first direction and sets a position to start scanning for each of the regions. The predetermined width equals a pitch of vibration of the scanning unit. The processor further determines a position to start scanning for each scanning operation, depending on which region the position to start recording is located, and controls the scanning unit to move the recording head to the determined position to start scanning for each scanning operation.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 12 is a table illustrating the relationship between usable recording heads and recording modes which can be utilized by each of the recording heads;

DETAILED DESCRIPTION OF THE PREFERRED EMBODIMENTS

Preferred embodiments of the present invention will now be described with reference to the drawings.

First Embodiment

Figure 1:
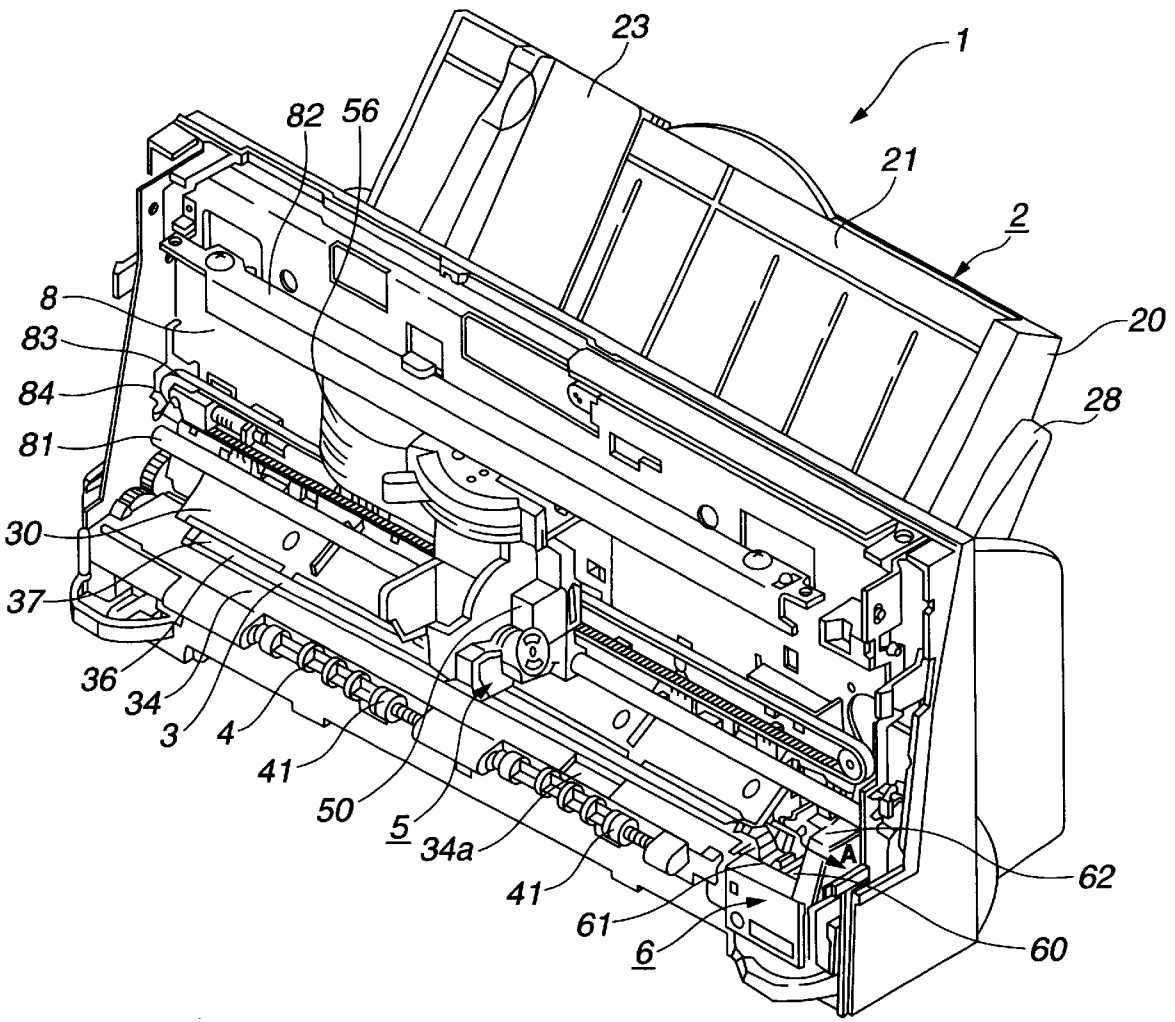
FIG. 1 is a perspective view illustrating an external appearance and the entire configuration of a recording apparatus for performing recording according to an ink-jet method, according to a first embodiment of the present invention.
Figure 2:
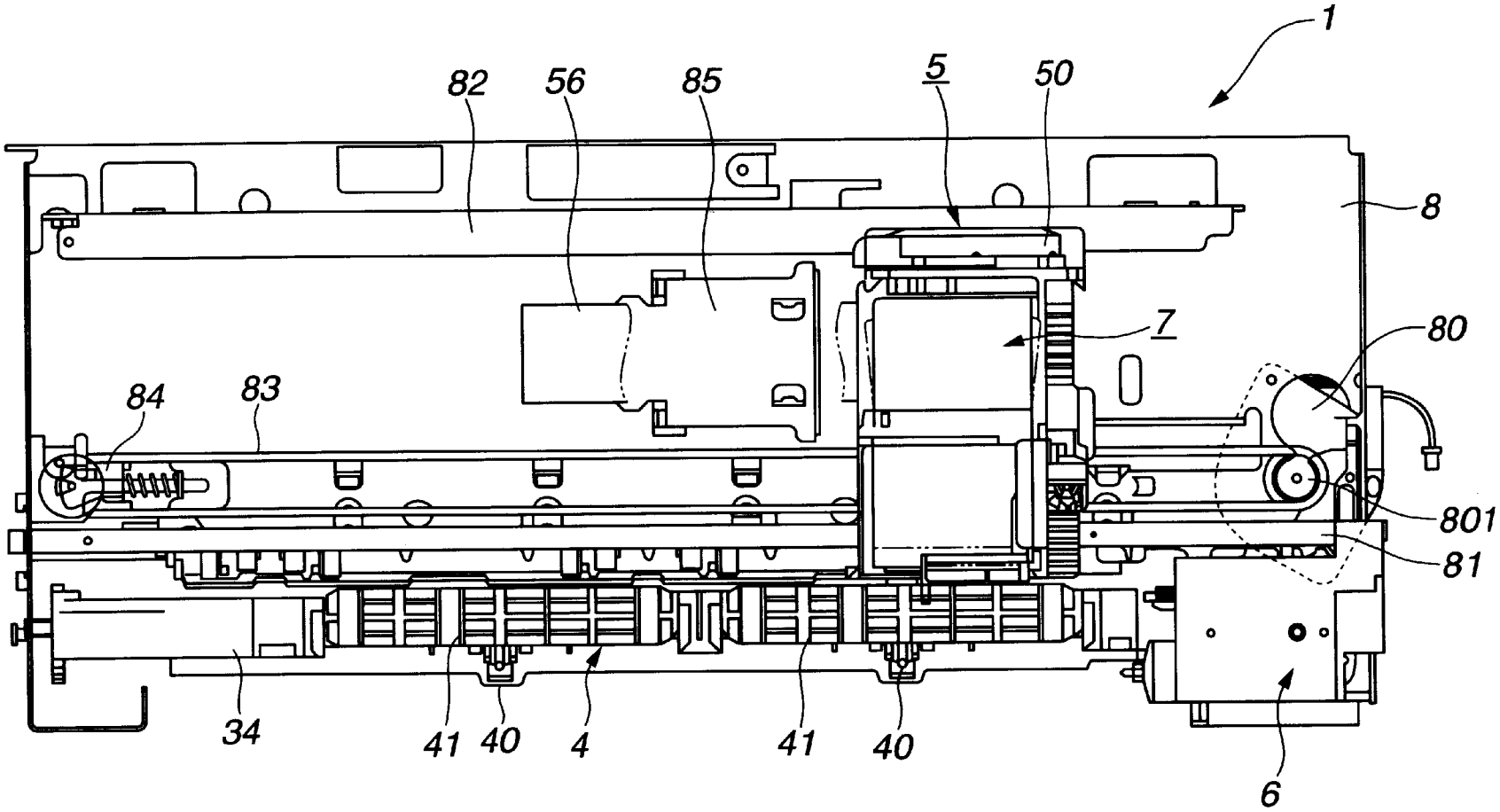
FIG. 2 is a front view of the recording apparatus shown in FIG. 1.
Figure 3:
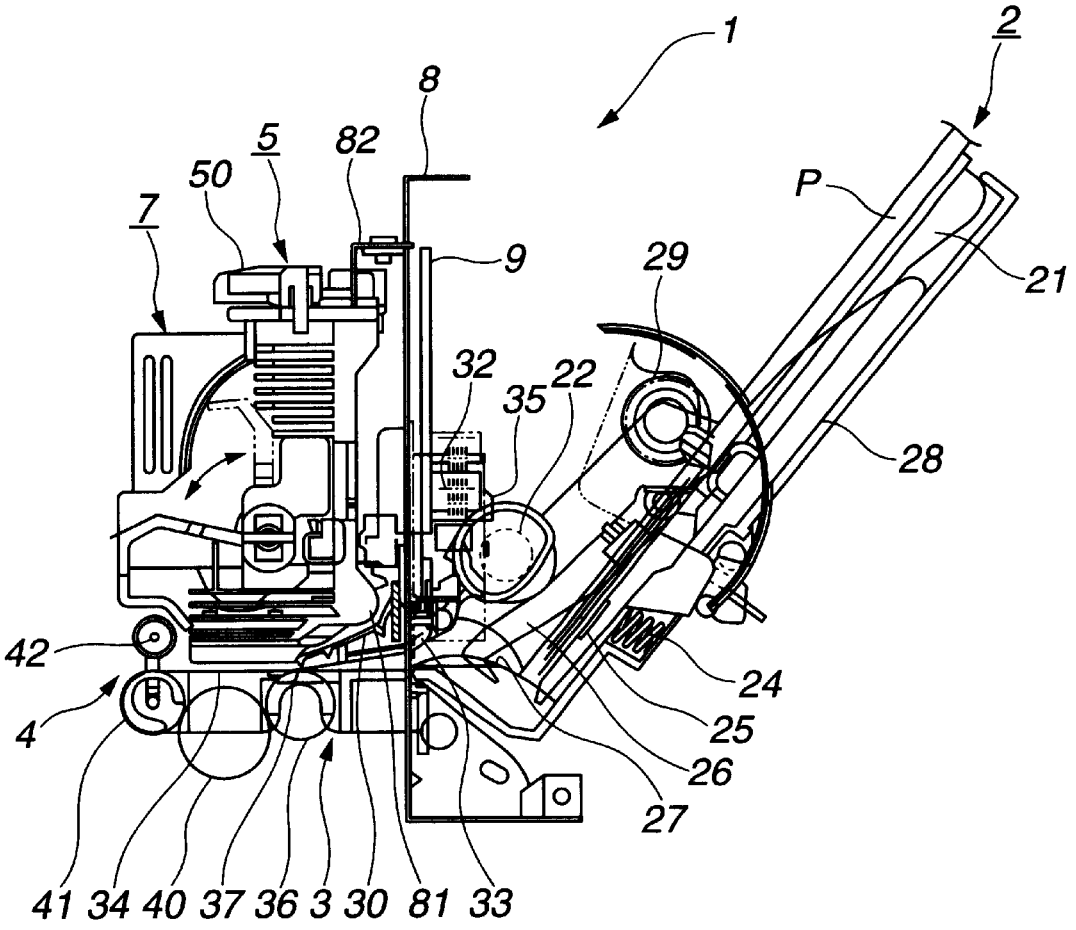
FIG. 3 is a side cross-sectional view of the recording apparatus shown in FIG. 1.

FIGS. 1–3 illustrate a recording apparatus 1 mounting an ink-jet recording head on a carriage, for effecting recording on a recording medium by performing serial scanning using the carriage. The recording apparatus 1 uses a stepping motor as a carriage motor, serving as a driving source for performing reciprocating scanning using the carriage mounting the recording head. The recording apparatus 1 also includes an automatic sheet feeder (ASF) for automatically feeding sheets of the recording medium, such as recording paper or the like.

FIG. 1 is a perspective view illustrating an external appearance and the entire configuration of the recording apparatus. FIG. 2 is a front view of the recording apparatus 1. FIG. 3 is a side cross-sectional view of the recording apparatus 1.

The recording apparatus 1 includes a sheet feeding unit 2, a sheet conveying unit 3, a sheet ejecting unit 4, a carriage unit 5, and a cleaning unit 6 as main components. The configuration of each of these units will now be sequentially described with reference to FIGS. 1–3.

(Sheet feeding unit)

The sheet feeding unit 2 is configured such that a pressing plate 21 for mounting sheets of the recording medium (hereinafter termed "recording sheets P") and a feeding rotating member 22 for feeding the recording sheets P are mounted on a base 20. A movable side guide 23 is movably provided on the pressing plate 21, in order to regulate the mounting position of the recording sheets P. The pressing plate 21 is rotatable around a rotating shaft connected to the base 20, and is urged toward the feeding rotating member 22 by a pressing-plate spring 24. A separation pad 25 made of a material having a large coefficient of friction, such as artificial leather or the like, for preventing simultaneous feeding of two or more of the recording sheets P is provided at a portion of the pressing plate 21 facing the feeding rotating member 22. Separation pawls 26 covering corners of the recording sheets P in one direction and for individually separating the recording sheets P, and a bank portion 27 integrally formed with the base 20 and for separating the recording sheets P for which the separation pawls 26 cannot be used, such as thick paper or the like, are provided at the base 20. A switching lever 28 for performing switching such that the separation pawls 26 operate at a normal-paper position and do not operate at a thick-paper position, and a release cam 29 for releasing contact of the pressing plate 21 to the feeding rotating member 22 are also provided.

In the above-described configuration, in a waiting state, the release cam 29 depresses the pressing plate 21 to a predetermined position. Thus, the contact of the pressing plate 21 to the feeding rotating member 22 is released. When the driving force of a conveying roller 36 is transmitted to the feeding rotating member 22 and the release cam 29 via gears or the like in this state, the release cam 29 leaves the pressing plate 21, so that the pressing plate 21 is raised, and the feeding rotating member 22 contacts the recording sheets P, which are picked up in accordance with the rotation of the feeding rotating member 22 and start to be fed, and are individually separated by the separation pawls 26. The separated recording sheet P is fed to the sheet conveying unit 3. The feeding rotating member 22 and the release cam 29 rotate until the recording sheet P is fed to the sheet conveying unit 3. Then, a waiting state in which the contact of the recording sheet P to the feeding rotating member 22 is released is provided, and the driving force from the conveying roller 36 is not transmitted.

(Sheet conveying unit)

The sheet conveying unit 3 includes the conveying roller 36 for conveying the recording sheet P, and a PE (paper end) sensor 32. A pinch roller 37 driven by the conveying roller 36 is provided so as to contact the conveying roller 36. The pinch roller 37 is held on a pinch-roller guide 30, and is in pressure contact with the conveying roller 36 by being urged by a pinch-roller spring (not shown), to produce a conveying force for the recording sheet P. An upper guide 33 for guiding the recording sheet P, and a platen 34 are disposed at an entrance of the sheet conveying unit 3 where the recording sheet P is conveyed. A PE-sensor lever 35 for transmitting detection of the leading edge and the trailing edge of the recording sheet P to the PE sensor 32 is provided on the upper guide 33. A recording head 7 for forming an image based on image information is provided at a side downstream from the conveying roller 36 in the recording-sheet conveying direction.

In the above-described configuration, the recording sheet P fed to the sheet conveying unit 3 is conveyed to a roller pair comprising the conveying roller 36 and the pinch roller 37 by being guided by the platen 34, the pinch-roller guide 30 and the upper guide 33. At that time, the PE-sensor lever 35 detects the leading edge of the conveyed recording sheet P, in order to obtain the recording position on the recording sheet P. The recording sheet P is conveyed onto the platen 34 by the rotation of the roller pair 36, 37 caused by an LF motor (not shown).

An ink-jet recording head integrated with an ink tank so as to be easily exchanged is used as the recording head 7. The recording head 7 can provide ink with heat by means of a heater or the like. The ink is subjected to film boiling by this heat. The ink is discharged from a nozzle of the recording head 7 due to a change in the pressure caused by the growth or contraction of a bubble generated by film boiling, to form an image on the recording sheet P.

(Carriage unit)

The carriage unit 5 includes a carriage 50 for mounting the recording head 7. The carriage 50 is supported by a guide shaft 81 for causing reciprocating scanning in a direction orthogonal to the conveying direction of the recording sheet P, and a guide rail 82 for maintaining a gap between the recording head 7 and the recording sheet P by holding the rear end of the carriage 50. The guide shaft 81 and the guide rail 82 are mounted on a chassis 8. The carriage 50 is driven by a carriage motor 80 mounted on the chassis 8 via a timing belt 83. The timing belt 83 is stretched and supported by an idle pulley 84. The carriage 50 also includes a flexible substrate 56 for transmitting a head signal from an electric-component substrate 9 to the recording head 7.

In the above-described configuration, when forming an image on the recording sheet P, the roller pair 36, 37 conveys the recording sheet P to a line position for forming an image (a position in the conveying direction of the recording sheet P), and the carriage 50 is moved to a column position for forming the image (a position perpendicular to the conveying direction of the recording sheet P) by the carriage motor 80, in order to cause the recording head 7 to face a position to form the image. Then, the image is formed by causing the recording head 7 to discharge the ink toward the recording sheet P in accordance with a signal from the electric-component substrate 9.

(Sheet ejecting unit)

The sheet ejecting unit 4 is configured such that a transmission roller 40 contacts the conveying roller 36 and a sheet ejecting roller 41. Accordingly, the driving force of the conveying roller 36 is transmitted to the sheet ejecting roller 41 via the transmission roller 40. A spur 42 is brought in contact with the sheet ejecting roller 41 so as to be rotatable by being driven by the sheet ejecting roller 41.

In the above-described configuration, the recording sheet P having the image formed by the ink-jet head mounted on the carriage unit 5 is discharged onto a discharged-sheet tray (not shown) by being grasped and conveyed at a nip formed between the sheet ejecting roller 41 and the spur 42.

(Cleaning unit)

The cleaning unit 6 includes a pump 60 for cleaning the recording head 7, a cap 61 for preventing the recording head 7 from drying, and a driving switching arm 62 for switching the driving force from the conveying roller 36 to the sheet feeding unit 2 or the pump 60. In an operation other than a sheet feeding operation and a cleaning operation, the driving switching arm 62 fixes a planetary gear (not shown) rotating around the axis of the conveying roller 36 to a predetermined position. Hence, the driving force is not transmitted to the sheet feeding unit 2 and the pump 60. When the driving switching arm 62 is moved by the movement of the carriage 50, the planetary gear is freed. As a result, the planetary gear revolves in accordance with the forward or reverse rotation of the conveying roller 36. When the conveying roller 36 performs forward rotation, the driving force is transmitted to the sheet feeding unit 2. When the conveying roller 36 performs reverse rotation, the driving force is transmitted to the pump 60.

Next, a description will be provided of a method for driving the stepping motor used for driving the carriage unit 5 in the first embodiment.

Figure 4:
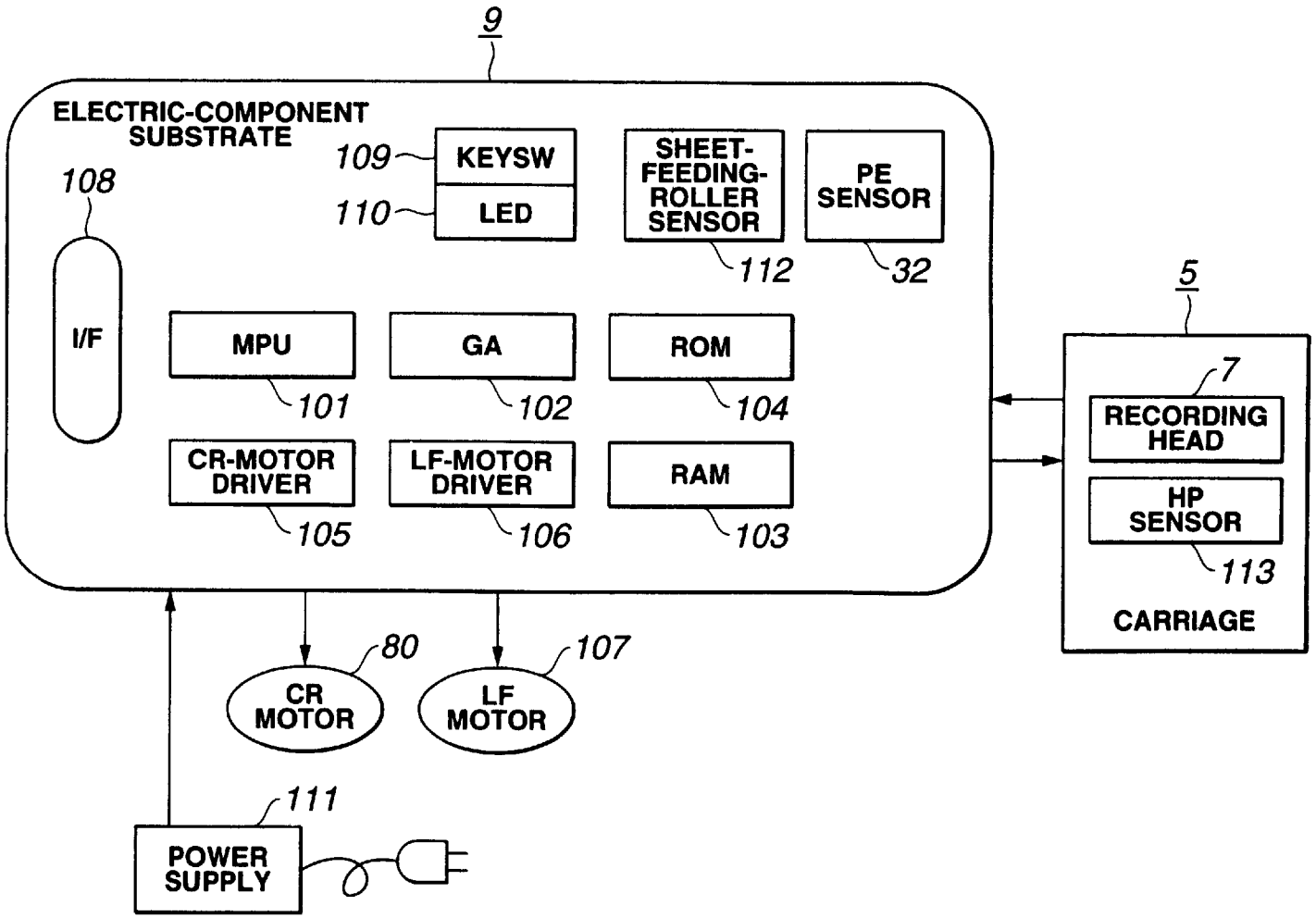
FIG. 4 is a block diagram illustrating the configuration of a control circuit of the recording apparatus shown in FIG. 1.

FIG. 4 is a block diagram illustrating the configuration of a control circuit of the recording apparatus 1.

In FIG. 4, an MPU (microprocessor unit) 101 controls motor driving and a recording operation. There are also shown a gate array (GA) 102, a DRAM (dynamic random access memory) 103, a ROM (read-only memory) 104, a carriage(CR)-motor driver 105, a conveying (LF (line feeding))-motor driver 106, a CR motor 80, a conveying (LF) motor 107, an interface (I/F) 108 for receiving recording data from a host computer, a key switch (KEYSW) 109 used by the user in order to provide various instructions, an LED (light-emitting diode) lamp 110 for transmitting the state of the apparatus to the user, the PE sensor 32 and a sheet-feeding-roller sensor 112 for supporting the function of the ASF mechanism.

The carriage unit 5 includes a home position (HP) sensor 113 for detecting a home position of the carriage 50.

The above-described control circuit operates by electric power supplied from a power-supply unit 111.

A driver according to a constant-current bipolar chopping method is used as the CR-motor driver 105. The MPU 101 transmits a signal representing the driving frequency and the current value corresponding to set parameters for the CR motor 80 to the CR-motor driver 105, which drives the CR motor 80. For example, a PM(phase modulation)-type stepping motor having a resolution of 96 steps with $\phi 42$ is used as the CR motor 80. Ferrite is used as the magnetic material of the rotor of the CR motor 80.

This stepping motor is subjected to two-phase driving, and the number of pulses applied to start the motor is 36. The starting pulse frequency is about 100 pps (pulses per second), and the frequency at a predetermined constant-speed region is about 1,000 pps. At that time, the ramp-up driving curve forms the shape of S obtained by connecting points of inflection of a cubic curve to a predetermined constant-speed frequency of about 1,000 pps. The ramp-down driving curve is substantially symmetrical with respect to the ramp-up driving curve.

Figure 5:
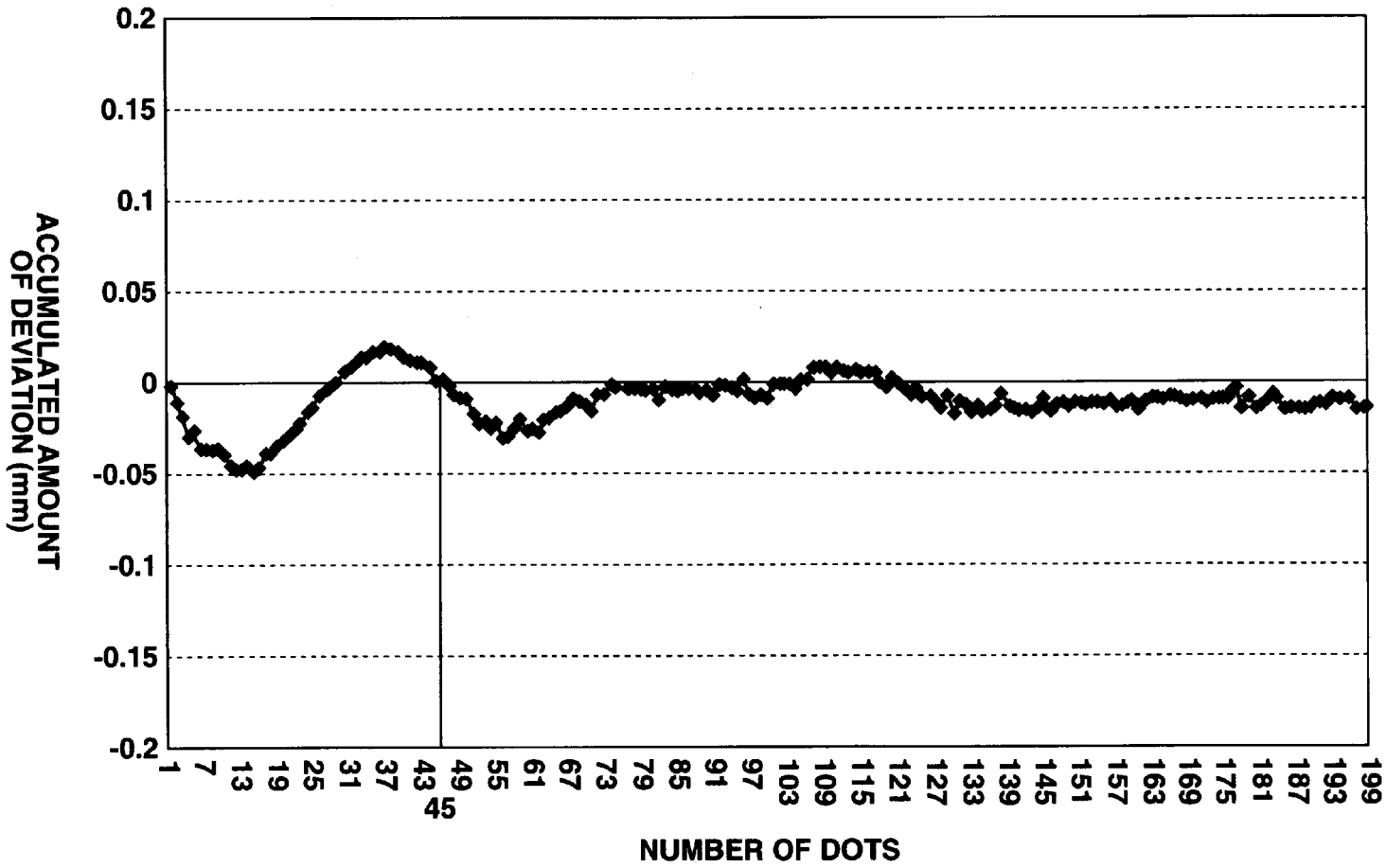
FIG. 5 is a diagram illustrating an example of accuracy in recorded positions when performing recording using a recording head 7.

FIG. 5 is a diagram illustrating an example of accuracy in recorded positions when performing recording by the recording head 7 (measurement of deviations of dots recorded with an interval of 1/90 inch).

Although the result more or less differs depending on the apparatus, accuracy in recorded positions is slightly degraded immediately after starting the CR motor 80 such that deviations in recorded positions are ±40 μm–50 μm. The accumulated amount of deviation changes with damped oscillation such that the deviations are thereafter stabilized and become ±10 μm–20 μm. Such tendency in accuracy in recording is maintained even after the recording scanning line changes. Accordingly, when recording an image having vertically aligned recorded ends on a recording sheet, the point to start the carriage 50 for each scan is constant. In this case, even if accuracy in recording is rather inferior immediately after starting the CR motor 80, since recorded dots are deviated in the same manner as during scanning of the preceding line, the deviation in the recorded image is less pronounced.

Figure 6:
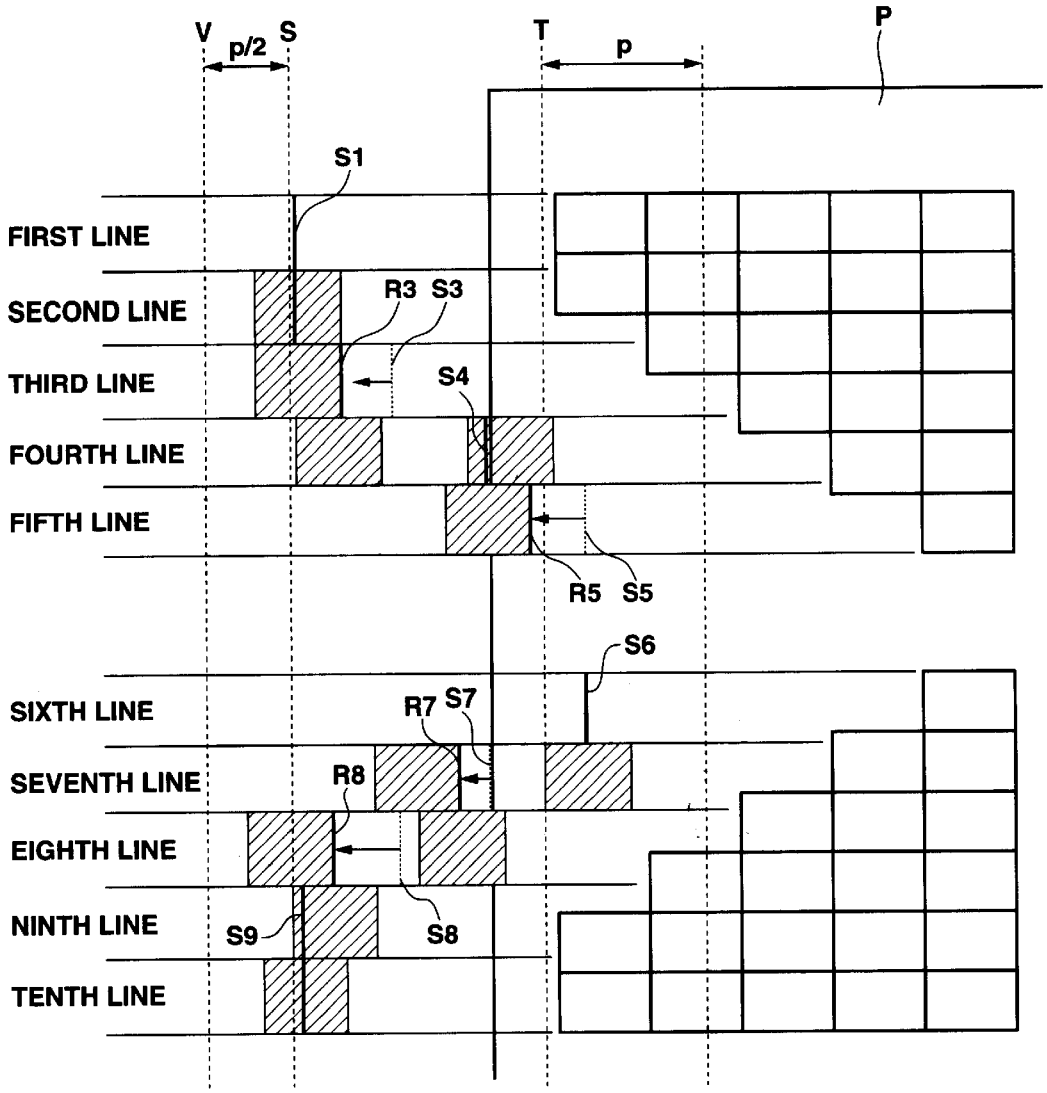
FIG. 6 is a diagram illustrating recording control for a carriage according to the first embodiment.

FIG. 6 is a diagram illustrating a manner of recording stepwise ruled lines on a recording sheet P.

Figure 13:
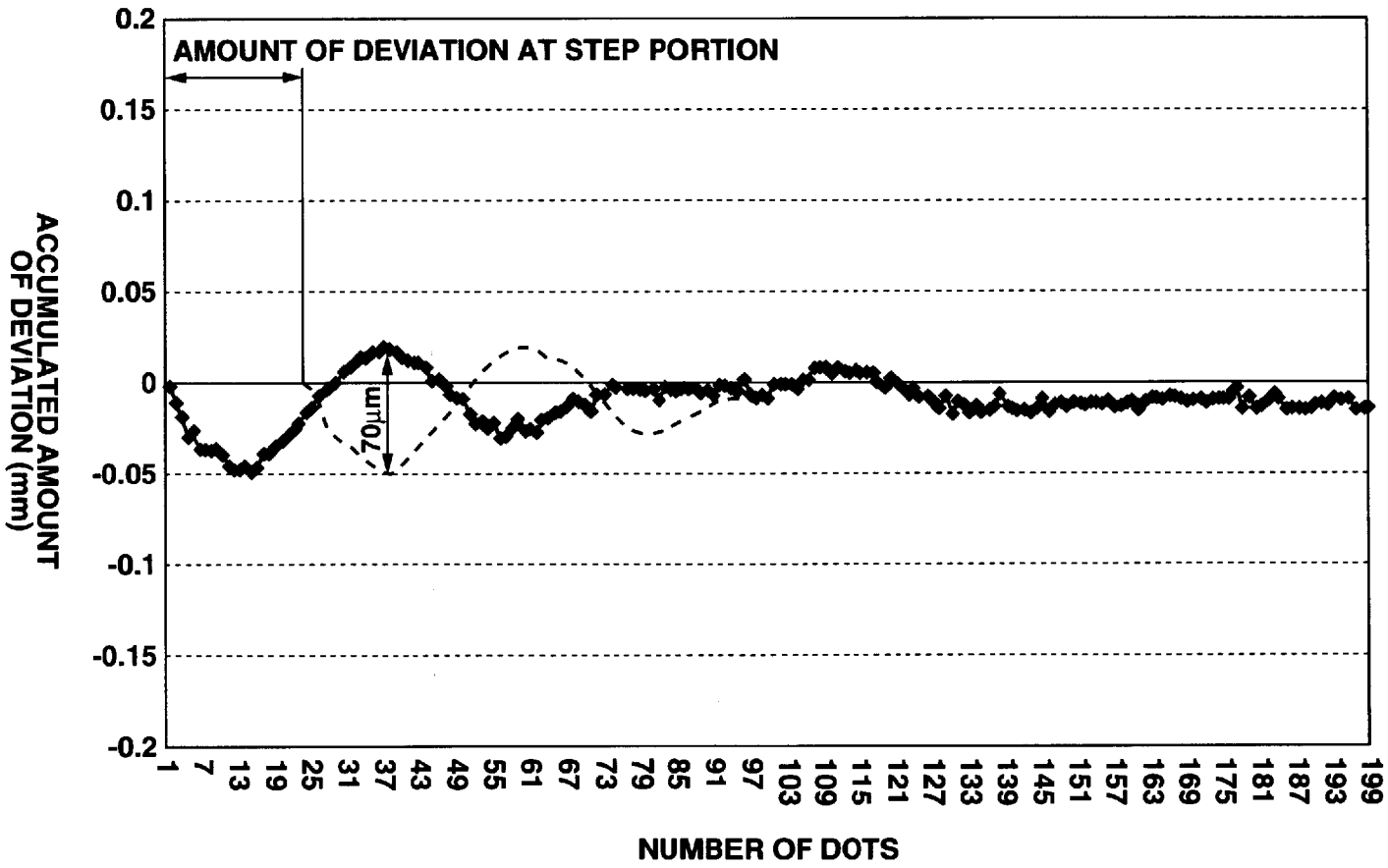
FIG.13 PRIOR ART
FIG. 13 is a diagram illustrating accuracy in recorded positions in a conventional approach.
Figure 14:
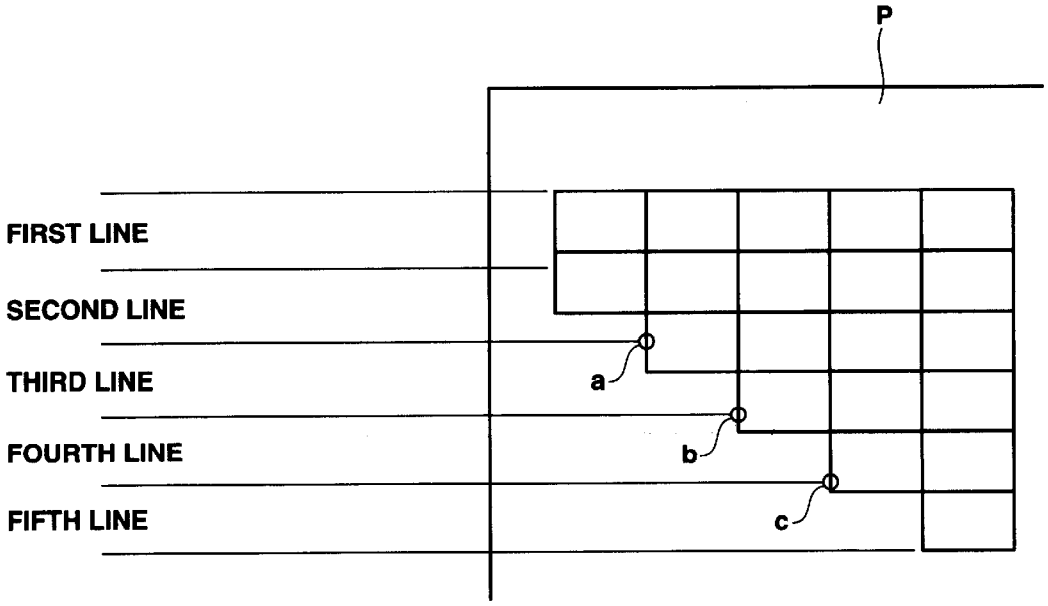
FIG.14 PRIOR ART
FIG. 14 is a diagram illustrating recording control in the conventional approach.

As described in the conventional approach, when recording stepwise ruled lines as shown in FIG. 6, the position to start movement of the carriage 50 shifts with every recording line. In this case, as described in the conventional approach with reference to FIG. 13, a deviation in the recorded position as large as 70 μm–80 μm sometimes occurs between adjacent recorded lines. This deviation causes deviations between ruled lines particularly when recording, for example, stepwise ruled lines, and nonuniformity in recording when performing recording with high resolution. As described in the conventional approach, the cause of degraded accuracy in recording is variations in the speed of the carriage due to vibration of the mechanical system including the CR motor 80. In such a mechanical configuration, a vibration having a substantially constant pitch p is produced. The pitch p is a period until the accumulated amount of deviation becomes 0 in the graph of accuracy in recorded positions shown in FIG. 5 (measurement of deviations of dots recorded at an interval of 1/90 inch), and is about 45 dots in this case.

In the first embodiment, in order to solve the above-described problems, the following recording control is executed.

It is assumed that the recording head 7 is a head for recording a monochromatic image having 64 nozzles with a resolution of 360 dpi (dots per inch), and that the stepping motor used as the CR motor 80 can move the carriage 50 by a distance for recording 6 dots of the recorded image per driving pulse. As shown in FIG. 6, a description will be provided of a case of forming stepwise ruled lines descending toward the right while performing one-direction recording from the left to the right on a recording sheet P.

In FIG. 6, P represents a recording sheet, and T represents the left end of a recordable range. Usually, T is set to about 3 mm–5 mm from the edge of the recording sheet. S represents a position to start movement of the carriage 50 when performing recording from the left end T of the recordable range. The distance between S and T equals the distance of the movement of the carriage 50 caused by 36 driving pulses input to the stepping motor (corresponding to 216 recorded dots).

The cleaning unit is provided at a portion outside of S (a side opposite to T). An auxiliary start region having a width of p/2 which does not interfere with the cleaning unit is provided. V represents the end of the auxiliary start region. The pitch p corresponds to 180 recorded dots with a resolution of 360 dpi, and 30 driving pulses for the motor.

When recording is performed according to the conventional approach in the above-described conditions, recording by the recording head starts from S1, S3, S4 and S5 for the first and second lines, the third line, the fourth line and the fifth line, respectively. Hence, there is the possibility that deviations occur at connected portions of the ruled lines as described above.

Figure 7:
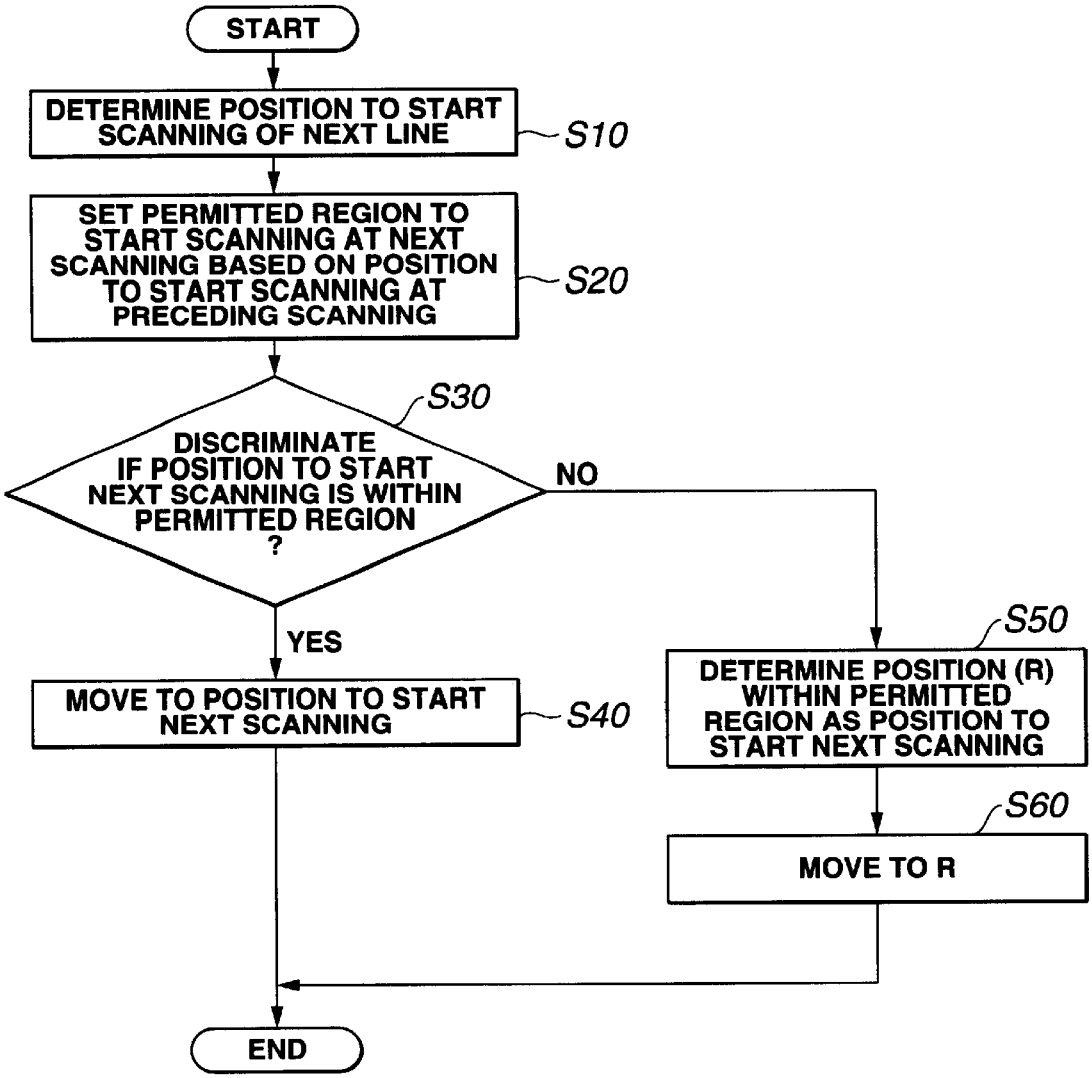
FIG. 7 is a flowchart illustrating the processing of the recording control.

In the first embodiment, by the control circuit of FIG. 4 executing the processing of recording control shown in the flowchart of FIG. 7, deviations in recorded dots are prevented. That is, the position to start scanning of the carriage for the next line after recording one line is arranged to be within a permitted or permissible region to start scanning which equals n×p+p/4 (n is an integer) with respect to the position to start scanning of the carriage for the preceding line.

First, in step S10, the position to start scanning is determined from recording data for one scanning operation for the next line. Then, in step S20, the permitted region to start scanning for the next line is set based on the position to start scanning for the preceding line. Then, in step S30, it is determined if the position to start scanning for the next scanning operation obtained in step S10 is within the permitted region to start scanning set in step S20.

If the result of the determination in step S30 is affirmative, the process proceeds to step S40, where the carriage moves to the position to start scanning for the next scanning operation. If the result of the determination in step S30 is negative, the process proceeds to step S50, where the position to start scanning is determined to be a position (R) within the permitted region. At that time, the carriage moves to a position within the permitted region for which driving pulses input to the motor increase. Then, in step S60, the carriage moves to the position R.

According to the above-described processing, for example, when recording the stepwise ruled lines shown in FIG. 6, scanning for recording by the recording head starts from S1 for the first and second lines. Conventionally, scanning for recording for the third line starts from S3. In the first embodiment, however, since S3 is not within the hatched permitted region to start scanning based on the start position S1 when recording the second line, scanning for recording starts from R3 within the permitted region to start scanning for which driving pulses input to the motor increase. Scanning for recording for the fourth line starts from S4 as in the conventional approach, since S4 is within the hatched permitted region to start scanning based on the start position R3 when recording the third line. Conventionally, scanning for recording for the fifth line starts from S5. In the first embodiment, however, since S5 is not within the hatched permitted region to start scanning based on the start position S4 when recording the fourth line, scanning for recording starts from R5 within the permitted region to start scanning.

Next, a description will be provided of a case of recording stepwise ruled lines descending toward the left. Scanning for recording by the recording head for the sixth line starts from S6. Conventionally, scanning for recording for the seventh line starts from S7. In the first embodiment, however, since S7 is not within the hatched permitted region to start scanning based on the start position S6 when recording the sixth line, scanning for recording starts from R7 within the permitted region to start scanning. Conventionally, scanning for recording for the eighth line starts from S8. In the first embodiment, however, since S8 is not within the hatched permitted region to start scanning based on the start position R7 when recording the seventh line, scanning for recording starts from R8 within the permitted region to start scanning. Since the conventional start position S9 for the ninth line is within the hatched permitted region to start scanning based on the start position R8 when recording the eighth line, scanning for recording starts from S9 as in the conventional approach. Similarly, recording starts from S9 for the tenth line.

For the recording for ruled lines descending toward the left, the permitted region to start scanning based on the start position for the preceding line is set to the left of S. For recording starting from T, recording can be performed by using the auxiliary start region.

Figure 8:
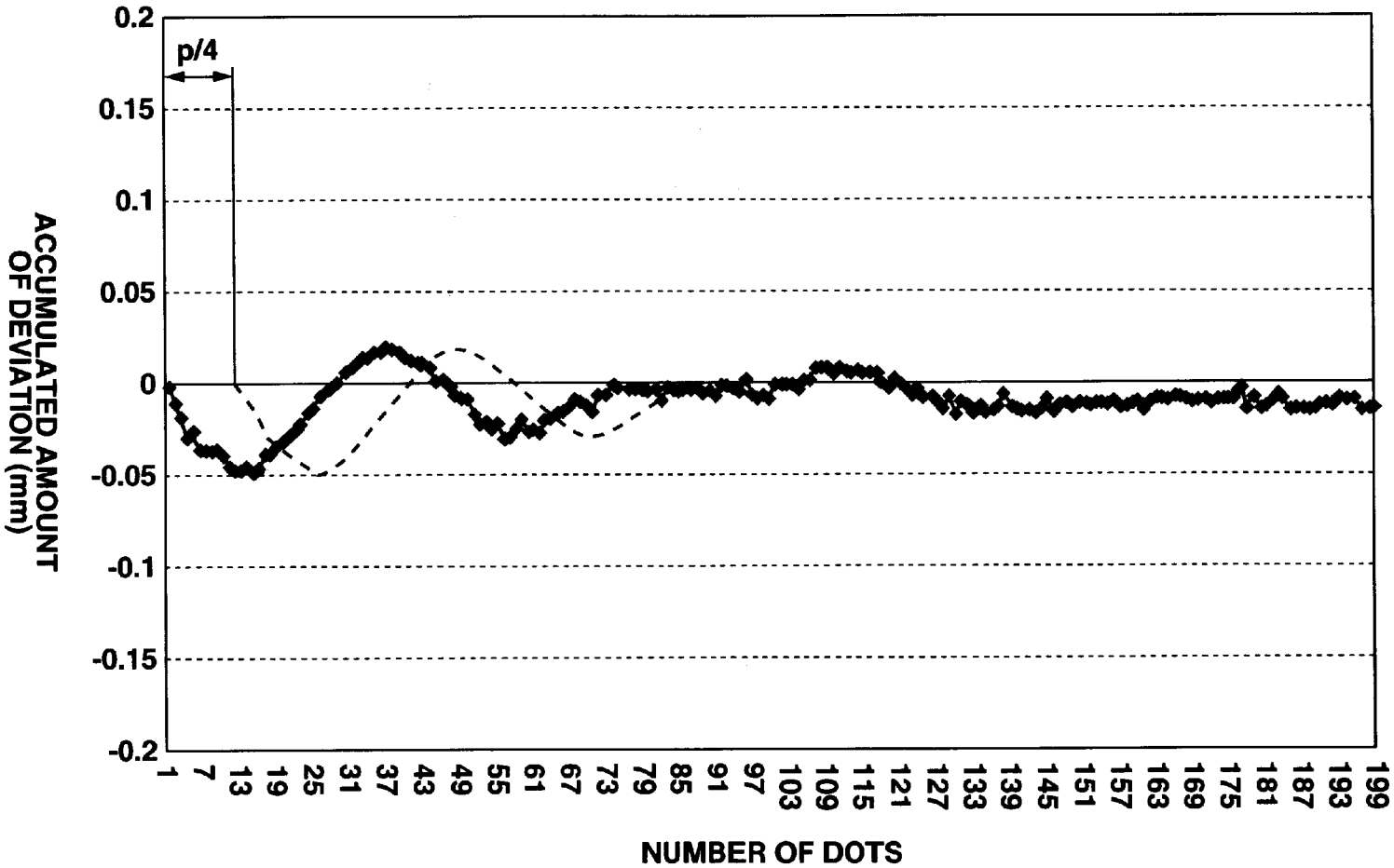
FIG. 8 is a diagram illustrating accuracy in recorded positions in the first embodiment.

According to the above-described control, deviation during scanning is largest when starting recording from the end of the permitted region to start scanning with respect to the start position for the preceding line, i.e., when the start position differs by p/4. FIG. 8 illustrates a case in which a graph obtained by shifting the start position by p/4 from the graph shown in FIG. 5 is superposed to the graph shown in FIG. 5. Even in this case, the crests and troughs of respective oscillations do not coincide. As a result, deviations in recorded positions can be reduced.

According to the above-described configuration, by setting a permitted region to start scanning having a width of n×p±p/4 with respect to the start position for the preceding line, and providing an auxiliary start region having a width of p/2, it is possible to minimize deviations between adjacent recorded lines over the entire recording region, and to record an excellent image.

In the first embodiment, since components such as an encoder, a high-resolution motor and the like are not required, an increase in the cost due to such components does not occur. Furthermore, since an increase in the distance of movement during start of the motor at the end of the recordable range can be reduced, the size of the apparatus is not increased.

In addition, because the control according to the first embodiment only sets the position to start scanning of the carriage by recognizing the position to start recording, the recorded image can be improved by a simple control operation.

Although in the first embodiment, the case of performing recording from the left end to the right end of the recording sheet P has been described, similar control may, of course, also be performed when performing recording from the right end to the left end.

Second Embodiment

Figure 9:
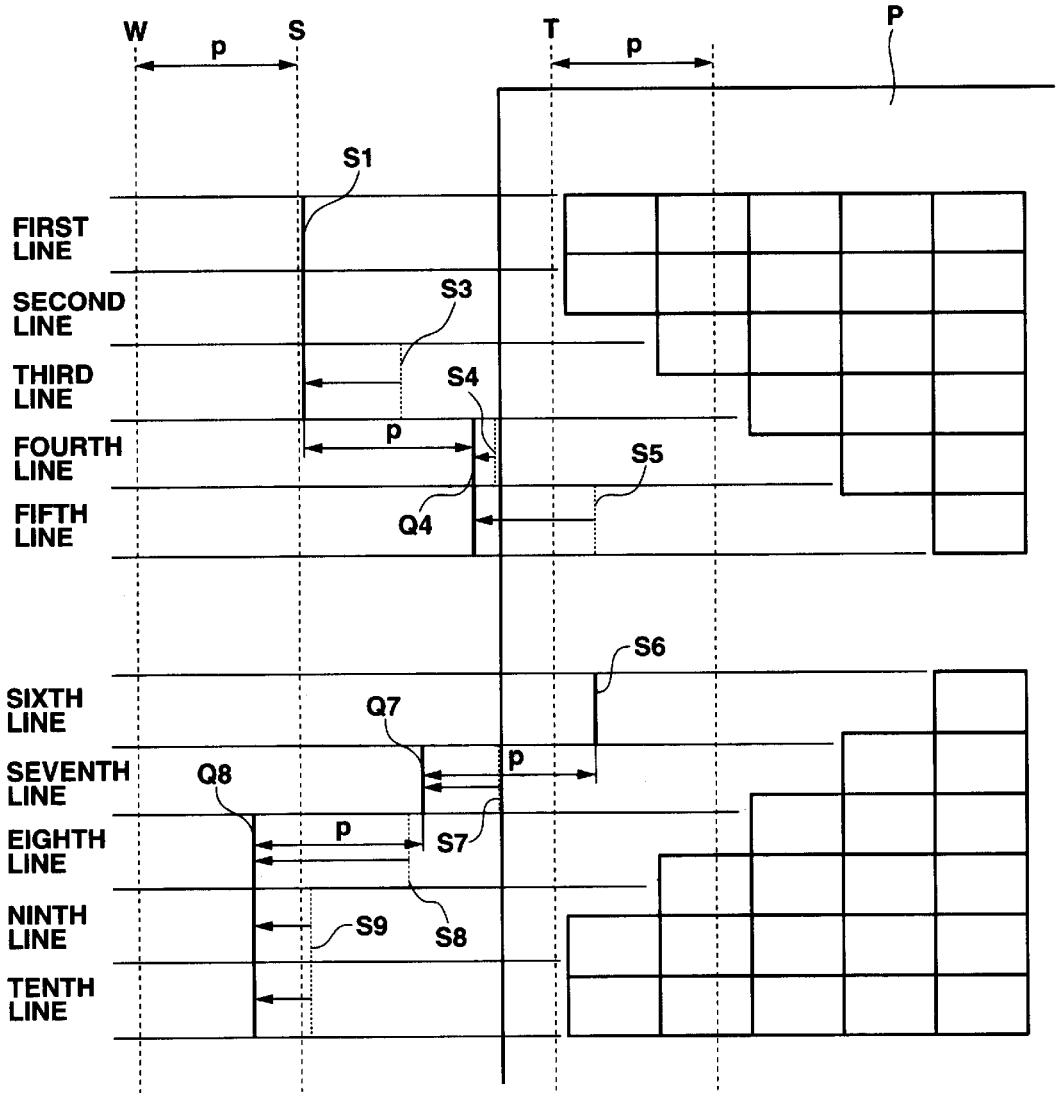
FIG. 9 is a diagram illustrating recording control for a carriage according to a second embodiment of the present invention.

FIG. 9 illustrates a second embodiment of the present invention. In FIG. 9, P represents a recording sheet, and T represents the left end of a recordable range. Usually, T is set to about 3 mm–5 mm from the edge of the recording sheet. S represents a position to start movement of the carriage 50 when performing recording from the left end T of the recordable range.

The cleaning unit is provided at a portion outside of S (a side opposite to T). An auxiliary start region having the width of the pitch p of the vibration which does not interfere with the cleaning unit is provided. W represents the end of the auxiliary start region.

In the second embodiment, the position to start scanning of the carriage for the next line after recording one line is arranged to be within a permitted or permissible region to start scanning which equals n×p (n is an integer) with respect to the position to start scanning of the carriage for the preceding line.

When performing recording under the above-described conditions, scanning for recording by the recording head starts from S1 for the first and second lines. Conventionally, scanning for recording for the third line starts from S3. In the second embodiment, however, since S3 is not within the permitted region to start scanning separated by p from the start position S1 when recording the second line, scanning for recording starts from S1 for which driving pulses increase. Conventionally, scanning for recording for the fourth line starts from S4. In the second embodiment, however, since S4 is not within the permitted region to start scanning separated by p from the start position S1 when recording the third line, scanning for recording starts from Q4. Conventionally, scanning for recording for the fifth line starts from S5. In the second embodiment, however, since S5 is not within the permitted region separated by p from the start position Q4 when recording the fourth line, scanning for recording starts from Q4.

Similarly, scanning for recording by the recording head for the sixth line starts from S6. Conventionally, scanning for recording for the seventh line starts from S7. In the second embodiment, however, since S7 is not within the permitted region to start scanning separated by p from the start position S6 when recording the sixth line, scanning for recording starts from Q7. Conventionally, scanning for recording for the eighth line starts from S8. In the second embodiment, however, since S8 is not within the permitted region to start scanning separated by p from the start position Q7 when recording the seventh line, scanning for recording starts from Q8. Conventionally, scanning for recording for the ninth and tenth lines starts from S9. In the second embodiment, however, scanning for recording starts from Q8 as when recording the eighth line.

Figure 10:
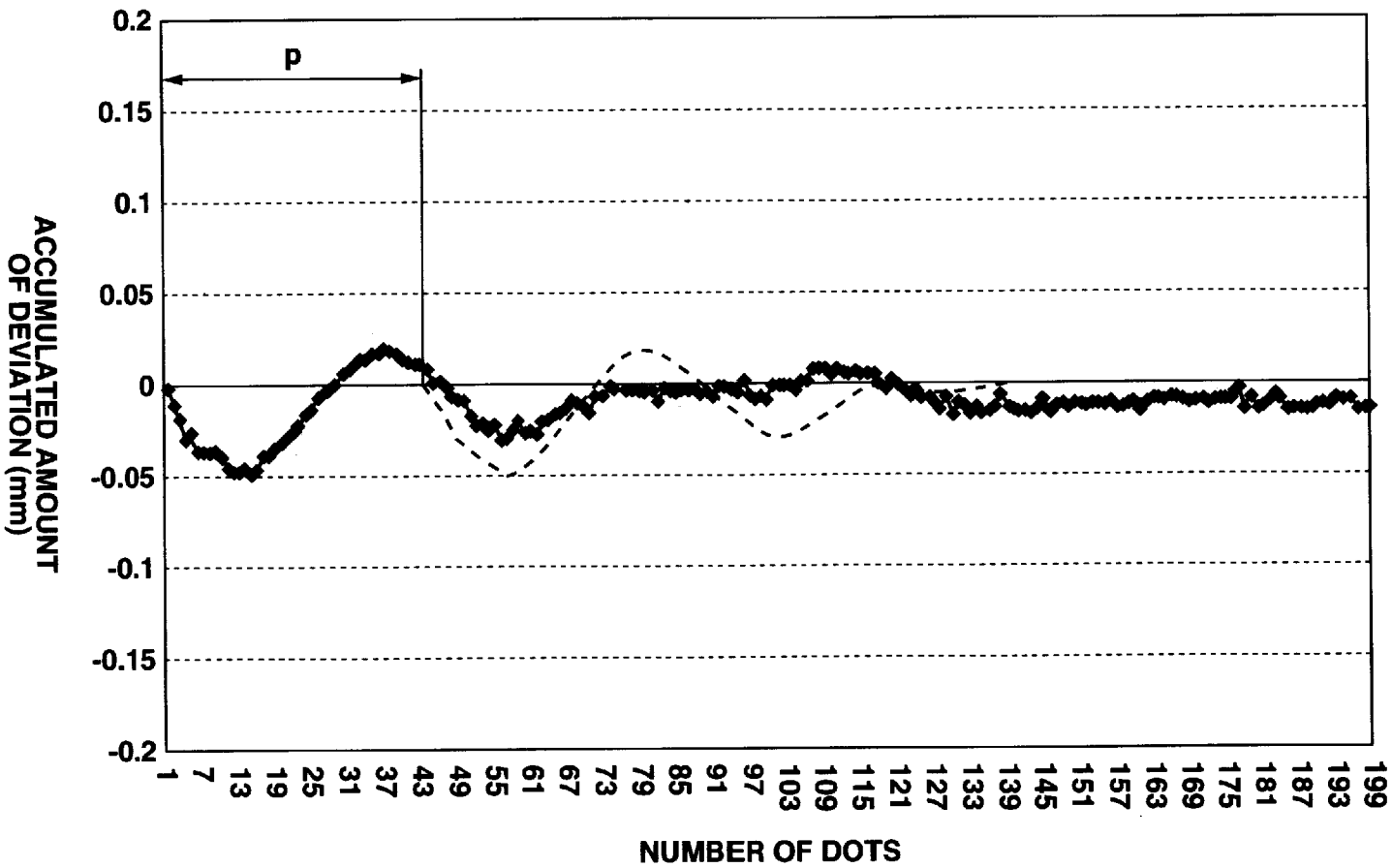
FIG. 10 is a diagram illustrating accuracy in recorded positions in the second embodiment.

FIG. 10 illustrates a case in which a graph obtained by shifting the start position by p from the graph shown in FIG. 5 is superposed to the graph shown in FIG. 5. In this case, since the crests and troughs of respective vibrations coincide, deviations in recorded positions can be reduced.

According to the above-described configuration, by setting a permitted region to start scanning separated by n×p (n is an integer) with respect to the start position for the preceding line, and providing an auxiliary start region having a width of p, it is possible to minimize deviations between adjacent recorded lines within the entire recording region, and to record an excellent image.

Third Embodiment

Figure 11:
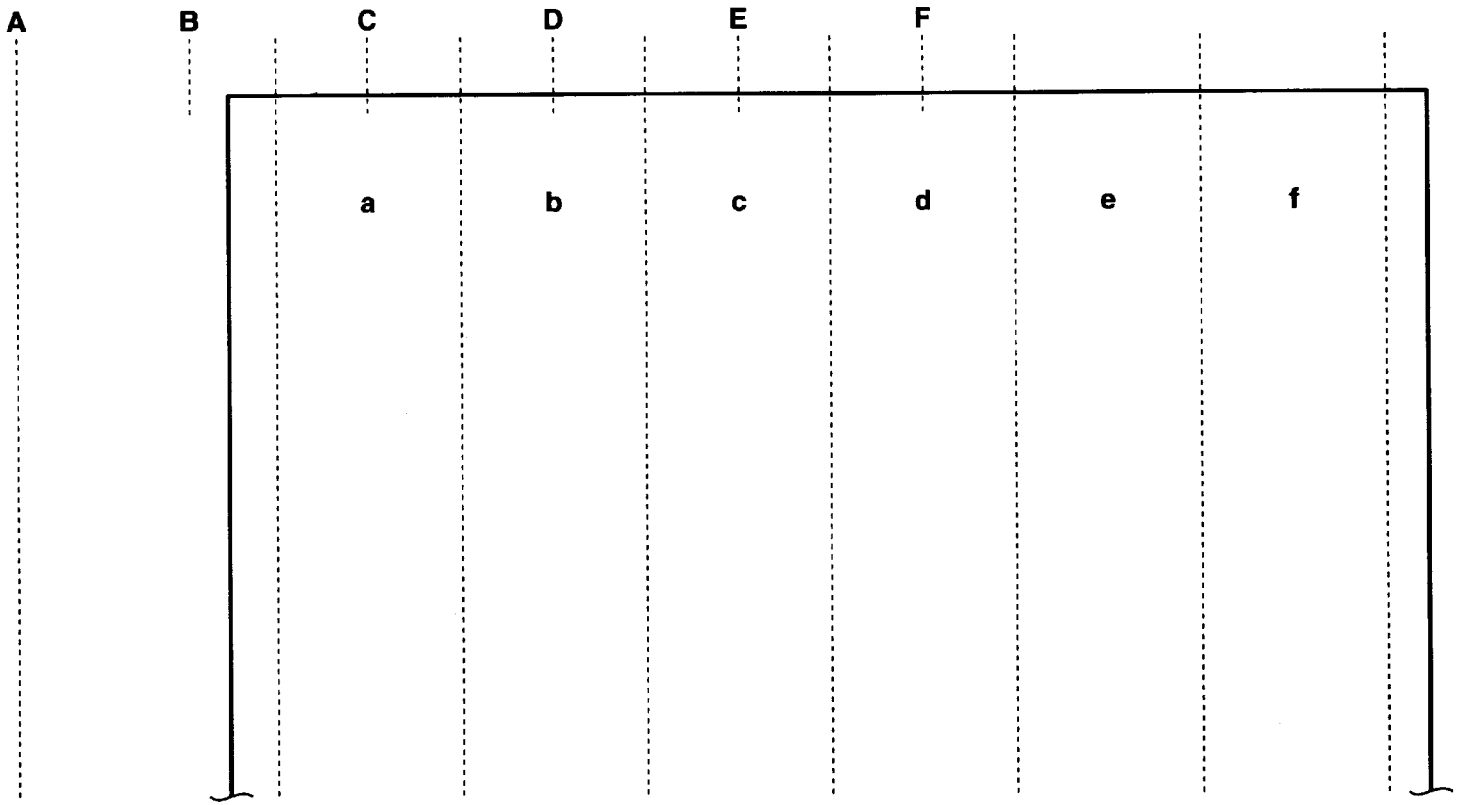
FIG. 11 is a diagram illustrating recording control for a carriage according to a third embodiment of the present invention.

FIG. 11 illustrates a third embodiment of the present invention.

In the third embodiment, a recording medium is divided into regions common to each line in units of a pitch p in the scanning direction of the carriage, and the start position of the carriage is fixed for each region.

In FIG. 11, regions a–f are set so as to have a width p. Start positions for the regions a, b and c are fixed to A, B and C, respectively. According to such a configuration, the start position of the carriage is determined depending on the region where the head of recording data for each recording line is present. Accordingly, as in the second embodiment, the start position of the carriage for the next line after recording one line is always shifted by an n multiple of the pitch p. Hence, the crests and troughs of respective oscillations coincide, and it is therefore possible to prevent deviations in recorded positions.

According to the above-described configuration, since a recording medium is divided into regions in units of a pitch p in the scanning direction of the carriage and the start position of the carriage is fixed for each region, it is possible to minimize deviations between adjacent recorded lines within the entire recording region, and to record an excellent image, by only determining the region where the head of recording data for a line to be recorded is present, and selecting the start position of the carriage in accordance with the determined region.

Another Embodiment

A description will be provided of a case of using the control described in each of the foregoing embodiments by selecting a recording mode from among various recording modes.

In this embodiment, the recording apparatus shown in FIGS. 1–4 has various recording modes for a recording head which can be exchanged as shown in FIG. 12, and recording is performed by a user selecting a necessary recording mode.

FIG. 12 is a table indicating the relationship between usable recording heads and recording modes which can be utilized by each of the recording heads.

In FIG. 12, each recording head has 64 nozzles. A monochrome head has only 64 nozzles for discharging black ink. A color head or a photograph head has 16 nozzles for discharging Y (yellow) ink, 16 nozzles for discharging M (magenta) ink, and 16 nozzles for discharging C (cyan) ink. A pitch covering 8 nozzles is provided in each nozzle group. Ink obtained by thinning ink used for the color head with a constant ratio is used for the photograph head. The photograph head can perform recording with larger gradation levels than that with the color head by performing superposed recording.

Of the recording modes, "HQ" represents a mode of performing high-quality recording with one-path recording, "Fine" represents a mode of increasing the quality of the recorded image by increasing the number of paths of recording per line, "HS" represents a high-speed recording mode, "smoothing" represents a mode of improving the reproducibility of an oblique line and the like by providing a resolution of 720 dpi, and "photograph" represents the above-described superposed-recording mode which is used for recording of a natural picture or the like. The carriage speed for each of the modes is as shown in FIG. 12.

In this embodiment, the control described in each of the above-described embodiments is applied in the HQ mode and the Fine mode (medium speed) when mounting the color head shown in FIG. 12. The control described in each of the above-described embodiments is not applied in the HS mode because speed is preferred over quality of the recorded image, or in the HQ mode for the monochrome head because deviations in recorded monochrome black dots are less pronounced. The control described in each of the above-described embodiments is not applied in the smoothing mode or the photograph mode. That is, deviations in recorded dots after starting the carriage motor are small because the speed of the carrier is low. Accordingly, even when recording stepwise ruled lines as described above, deviations between adjacent recorded lines are minimized, and therefore an excellent image can be recorded.

In this embodiment, the control described in each of the foregoing embodiments is applied only in a recording mode for which it is effective to apply the control, from among the selectable recording modes. Hence, it is possible to greatly improve the performance of the entire apparatus.

Although in the foregoing embodiments, a description has been provided illustrating an apparatus for performing recording according to serial scanning, the present invention may, of course, also be applied to an apparatus for performing recording only during scanning in one direction.

Although in the foregoing embodiments, a description has been provided assuming that a liquid droplet discharged from the recording head is ink, and that the liquid accommodated in the ink tank is ink, the used liquid is not limited to ink. For example, a processing liquid or the like to be discharged onto the recording medium in order to improve the fixability or the water resisting property of the recorded image, or the quality of the recorded image may be accommodated within the ink tank.

The present invention provides excellent effects for a recording head or a recording apparatus which includes means for generating thermal energy to be utilized for discharging ink (for example, electrothermal transducers, a laser beam or the like), and which adopts a method for causing a change in the state of ink by the thermal energy from among various types of ink-jet recording methods.

A typical configuration and principle of such a method are disclosed, for example, in U.S. Pat. Nos. 4,723,129 and 4,740,796. The disclosed method can be applied to both of so-called on-demand-type and continuous-type methods. Particularly, the on-demand type is effective because by applying at least one driving signal for causing a rapid temperature rise exceeding nucleate boiling to an electrothermal transducer disposed so as to face a sheet holding a liquid (ink or a processing liquid) or a liquid channel in accordance with recording information, thermal energy is generated in the electrothermal transducer to cause film boiling on the heat operating surface of the recording head and to form a bubble within the liquid (ink or the processing liquid) corresponding to the driving signal. By discharging the liquid (ink or the processing liquid) from the discharging opening due to the growth and contraction of the bubble, at least one droplet is formed. It is preferable to provide the driving signal in the form of a pulse because the bubble can be instantaneously and appropriately grown and contracted and the discharging of the liquid (ink or the processing liquid) with a high response speed can be achieved. A pulse-shaped driving signal such as those described in U.S. Pat. Nos. 4,463,359 and 4,345,262 is suitable. By adopting conditions described in U.S. Pat. No. 4,313,124 relating to the rate of temperature rise of the heat operating surface, more excellent recording can be performed.

In addition to the configuration of combining discharging ports, a liquid channel and electrothermal transducers (a linear liquid channel or an orthogonal liquid channel) as disclosed in the above-described patent applications, configurations described in U.S. Pat. Nos. 4,558,333 and 4,459,600 in which a heat operating unit is disposed at a bent region of the liquid channel may also be adopted for the recording head of the present invention. In addition, the present invention is also effective for a configuration disclosed in Japanese Patent Application Laid-Open No. 59-123670/1984 in which a common slit is used as a discharging port for a plurality of electrothermal transducers, and to a configuration disclosed in Japanese Patent Application Laid-Open No. 59-138461/1984 in which an aperture for absorbing the pressure wave of thermal energy is used as a discharging port. That is, according to the present invention, recording can be assuredly and efficiently performed irrespective of the form of the recording head.

Furthermore, the present invention is also effective for serial-type heads as described above, for example, a recording head fixed to the main body of the apparatus, an exchangeable chip-type recording head capable of electric connection to the main body of the apparatus and ink supply from the main body of the apparatus by being mounted on the main body of the apparatus, and a cartridge-type recording head having an ink tank provided integrally therewith.

The addition of means for recovering a discharging operation of the recording head, preliminary auxiliary means and the like is preferable because the effects of the present invention can be more stabilized. More specifically, these means include capping means, cleaning means, and pressurizing or suctioning means for the recording head, preliminary heating means for performing heating using an electrothermal transducer, a heating element other than the electrothermal transducer, or a combination of these elements, and preliminary discharging means for performing discharging other than recording.

As for the type or the number of recording heads to be mounted, for example, a single head for monochromatic ink, or a plurality of heads for a plurality of ink liquids having different colors and density values may be used. That is, the present invention is very effective for a recording mode using a single color, such as black or the like, an integrally formed recording head, a combination of a plurality of recording heads, and a recording apparatus which has at least one of a recording mode using a plurality of different colors and a recording mode of obtaining a full-color image by mixing colors.

Although in the foregoing embodiments, a description has been provided illustrating ink in the form of a liquid, ink which is solidified at a temperature equal to or lower than room temperature and is softened or liquefied at room temperature may also be used. In the ink-jet method, ink itself is generally subjected to temperature control within a range of 30° C.–70° C. so that the viscosity of the ink is within a range of stable discharge. Hence, ink which is liquefied when a recording signal is applied may also be used. Furthermore, in order to prevent temperature rise due to thermal energy by using the energy for liquefying ink from a solidified state or to prevent evaporation of ink, ink which is usually solid and is liquefied by being heated may also be used. Anyway, the present invention can also be applied to a case in which ink is liquefied by providing thermal energy corresponding to a recording signal and the liquefied ink is discharged, and to a case of using ink which is liquefied by providing thermal energy and starts to be solidified when it reaches a recording medium. As disclosed in Japanese Patent Application Laid-Open Nos. 54-56847/1979 and 60-71260/1985, such ink may be provided so as to face an electrothermal transducer while being held in recesses or through holes of a porous sheet in a liquid or solid state. In the present invention, the above-described film boiling method is most effective for the above-described ink.

The present invention may be applied to an image output terminal of an information processing apparatus, such as a computer or the like, a copier combined with a reader and the like, a facsimile apparatus having a transmission/reception function, and the like.

As described above, according to the foregoing embodiments, it is possible to minimize deviations between adjacent recorded lines over the entire recording region, and to record an excellent image.

In the present invention, since components such as an encoder, a high-resolution motor and the like are not required, an increase in the cost due to such components does not occur. Furthermore, since an increase in the distance of movement during start of the motor at the end of the recordable range can be reduced, the size of the apparatus is not increased.

The individual components shown in outline or designated by blocks in the drawings are all well known in the printing apparatus and printing control method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus comprising:

scanning means for mounting a recording head for forming an image on a recording medium and for performing reciprocating scanning in a first direction;

conveyance means for conveying the recording medium in a second direction transverse to the first direction;

input means for inputting recording data;

first determination means for determining a position to start scanning of the recording head relative to the recording medium for each scanning operation during recording, based on the recording data input by said input means;

setting means for setting a permissible region to start scanning in a next scanning operation, based on a position to start scanning in a preceding scanning operation;

discrimination means for discriminating whether or not a position to start scanning for the next scanning operation is within the permissible region;

second determination means for determining a position within the permissible region as a position to start scanning of the recording head by said scanning means, when said discrimination means discriminates that the position to start scanning for the next scanning operation is outside of the permissible region to start scanning; and movement means for moving the recording head to the position determined by said second determination means.

2. A recording apparatus according to claim 1, wherein the permissible region to start scanning is set based on a pitch (p) of vibration of said scanning means.

3. A recording apparatus according to claim 2, wherein a region separated from the position to start scanning for the preceding scanning operation by $n \times p \pm p/4$ (n is an integer) is set as the permissible region to start scanning in the next scanning operation.

4. A recording apparatus according to claim 3, wherein an auxiliary region to start scanning is provided outside of the position to start scanning with respect to an end of a recordable range of the recording head.

5. A recording apparatus according to claim 2, wherein a region separated from the position to start scanning for the preceding scanning operation by $n \times p$ (n is an integer) is set as the permissible region to start scanning in the next scanning operation.

6. A recording apparatus according to claim 5, wherein an auxiliary region to start scanning is provided outside of the position to start scanning with respect to an end of a recordable range of the recording head.

7. A recording apparatus according to claim 1, wherein said scanning means comprises a carriage for mounting the recording head and a carriage motor for generating a driving force to move said carriage.

8. A recording apparatus according to claim 7, wherein said carriage motor is a stepping motor.

9. A recording apparatus according to claim 1, wherein the recording head is detachable with respect to said scanning means, and is selected from a plurality of types of recording heads that are mountable on said scanning means.

10. A recording apparatus according to claim 9, wherein the plurality of types of recording heads comprises a recording head for monochromatic recording, a recording head for color recording and a recording head for photograph recording.

11. A recording apparatus according to claim 9, wherein the recording head is an ink-jet recording head for performing recording by discharging ink.

12. A recording apparatus according to claim 11, wherein the ink-jet recording head comprises electrothermal transducers for generating thermal energy to be applied to the ink in order to discharge the ink.

13. A recording apparatus according to claim 9, wherein a plurality of selectable recording modes are provided for each of the plurality of types of recording heads.

14. A recording apparatus according to claim 13, wherein said setting means is operable in a specific recording mode from among the plurality of recording modes.

15. A recording apparatus comprising:

scanning means for mounting a recording head for forming an image on a recording medium and for performing reciprocating scanning in a first direction;

conveyance means for conveying the recording medium in a second direction transverse to the first direction;

input means for inputting recording data;

first determination means for determining a position to start recording of the recording head on the recording medium for each scanning operation during recording, based on the recording data input by said input means;

setting means for dividing a recordable area of the recording medium into regions along the first direction, with each region having a predetermined width in the first direction and for setting a position to start scanning for each of the regions, the predetermined width equaling a pitch of vibration of said scanning means;

second determination means for determining a position to start scanning for each scanning operation, depending on which region the position to start recording is located; and movement means for moving the recording head to the position to start scanning determined by said second determination means for each scanning operation.

16. A recording apparatus according to claim 15, wherein said scanning means comprises a carriage for mounting the recording head and a carriage motor for generating a driving force to move said carriage.

17. A recording apparatus according to claim 16, wherein said carriage motor is a stepping motor.

18. A recording apparatus according to claim 15, wherein the recording head is detachable with respect to said scanning means, and is selected from a plurality of types of recording heads that are mountable on said scanning means.

19. A recording apparatus according to claim 18, wherein the plurality of types of recording heads comprises a recording head for monochromatic recording, a recording head for color recording, and a recording head for photograph recording.

20. A recording apparatus according to claim 18, wherein the recording head is an ink-jet recording head for performing recording by discharging ink.

21. A recording apparatus according to claim 20, wherein the ink-jet recording head comprises electrothermal transducers for generating thermal energy to be applied to the ink in order to discharge the ink.

22. A recording apparatus according to claim 18, wherein a plurality of selectable recording modes are provided for each of the plurality of types of recording heads.

23. A recording apparatus according to claim 22, wherein said setting means is operable in a specific recording mode from among the plurality of recording modes.

24. A recording control method applied to a recording apparatus mounting a recording head for forming an image on a recording medium and having a carriage for performing reciprocating scanning in a predetermined direction, said method comprising:

an input step of inputting recording data;

a first determination step of determining a position to start scanning of the recording head relative to the recording medium for each scanning operation during recording, based on the recording data input in said input step;

a setting step of setting a permissible region to start scanning in a next scanning operation, based on a position to start scanning in a preceding scanning operation;

a discrimination step of discriminating whether or not a position to start the next scanning operation is within the permissible region;

a second determination step of determining a position within the permissible region as a position to start scanning of the recording head, when said discrimination step discriminates that the position to start scanning of the next scanning operation is outside of the permissible region; and a movement step of moving the recording head to the position determined in said second determination step, before recording in the next scanning operation.

25. A recording control method applied to a recording apparatus mounting a recording head for forming an image on a recording medium and having a carriage for performing reciprocating scanning in a predetermined direction, said method comprising:

an input step of inputting recording data;

a first determination step of determining a position to start recording of the recording head on the recording medium for each scanning operation during recording, based on the recording data input in said input step;

a setting step of dividing a recordable area of the recording medium into regions along the predetermined direction, with each region having a predetermined width in the predetermined direction and for setting a position to start scanning for each of the regions, the predetermined width equaling a pitch of vibration of the carriage;

a second determination step of determining a position to start scanning for each scanning operation, depending on which region the position to start recording is located; and a movement step of moving the recording head to the position to start scanning determined in said second determination step for each scanning operation.

26. A recording apparatus comprising:

a scanning unit including a carriage for mounting a recording head for forming an image on a recording medium and a carriage motor for reciprocatingly scanning the carriage in a first direction;

a conveyance unit for conveying the recording medium in a second direction transverse to the first direction;

an input unit for inputting recording data; and a processor, said processor determining a position to start scanning of the recording head relative to the recording medium for each scanning operation during recording, based on the recording data input by said input unit, setting a permissible region to start scanning in a next scanning operation, based on a position to start scanning in a preceding scanning operation, discriminating whether or not a position to start scanning for the next scanning operation is within the permissible region, determining a position within the permissible region as a position to start scanning of the recording head by said scanning unit, when discriminated that the position to start scanning for the next scanning operation is outside of the permissible region to start scanning, and controlling said scanning unit to move the recording head to the determined position.

27. A recording apparatus according to claim 26, wherein the permissible region to start scanning is set based on a pitch (p) of vibration of said scanning unit.

28. A recording apparatus according to claim 27, wherein a region separated from the position to start scanning for the preceding scanning operation by $n \times p \pm p/4$ (n is an integer) is set as the permissible region to start scanning in the next scanning operation.

29. A recording apparatus according to claim 27, wherein a region separated from the position to start scanning for the preceding scanning operation by $n \times p$ (n is an integer) is set as the permissible region to start scanning in the next scanning operation.

30. A recording apparatus according to claim 26, wherein said carriage motor is a stepping motor.

31. A recording apparatus comprising:

a scanning unit including a carriage for mounting a recording head for forming an image on a recording medium and a carriage motor for reciprocatingly scanning the carriage in a first direction;

a conveyance unit for conveying the recording medium in a second direction transverse to the first direction;

an input unit for inputting recording data; and a processor, said processor determining a position to start recording of the recording head on the recording medium for each scanning operation during recording, based on the recording data input by said input unit, dividing a recordable area of the recording medium into regions along the first direction, with each region having a predetermined width in the first direction and setting a position to start scanning for each of the regions, the predetermined width equaling a pitch of vibration of said scanning unit, determining a position to start scanning for each scanning operation, depending on which region the position to start recording is located, and controlling said scanning unit to move the recording head to the determined position to start scanning for each scanning operation.

32. A recording apparatus according to claim 31, wherein said carriage motor is a stepping motor.

* * * * *